US009469432B2

(12) United States Patent
Aguirre

(10) Patent No.: US 9,469,432 B2
(45) Date of Patent: Oct. 18, 2016

(54) REINFORCED CONTAINERS AND BLANKS FOR MAKING THE SAME

(71) Applicant: WestRock Shared Services, LLC, Norcross, GA (US)

(72) Inventor: Ray Aguirre, Whittier, CA (US)

(73) Assignee: WestRock Shared Services, LLC, Norcross, GA (US)

( * ) Notice: Subject to any disclaimer, the term of this patent is extended or adjusted under 35 U.S.C. 154(b) by 0 days.

(21) Appl. No.: 14/931,651

(22) Filed: Nov. 3, 2015

(65) Prior Publication Data

US 2016/0122073 A1 May 5, 2016

Related U.S. Application Data

(60) Provisional application No. 62/074,909, filed on Nov. 4, 2014.

(51) Int. Cl.

| | |
|---|---|
| ***B65D 5/44*** | (2006.01) |
| ***B65D 5/20*** | (2006.01) |
| ***B65D 5/00*** | (2006.01) |
| ***B65D 5/22*** | (2006.01) |

(52) U.S. Cl.

CPC ..... *B65D 5/443* (2013.01); *B65D 5/0015* (2013.01); *B65D 5/20* (2013.01); *B65D 5/22* (2013.01)

(58) Field of Classification Search

CPC ..... B65D 5/443; B65D 5/0015; B65D 5/20
USPC ..... 229/100, 918, 190, 919, 170, 185.1
See application file for complete search history.

(56) References Cited

U.S. PATENT DOCUMENTS

| | | | |
|---|---|---|---|
| 2,522,597 | A | 9/1950 | Blandford |
| 2,832,270 | A | 4/1958 | Pierce, Jr. et al. |
| 3,034,698 | A | 5/1962 | Forrer |
| 3,883,067 | A | 5/1975 | McGlynn et al. |
| 3,940,053 | A | 2/1976 | Putman et al. |

(Continued)

FOREIGN PATENT DOCUMENTS

WO 9714552 A1 4/1997

OTHER PUBLICATIONS

International Search Report and Written Opinion, dated Nov. 13, 2014, for International application No. PCT/US14/37546 (16 pgs.).

(Continued)

*Primary Examiner* — Christopher Demeree
(74) *Attorney, Agent, or Firm* — WestRock IP Legal

(57) ABSTRACT

A container formed from a blank and a method for constructing the container are described. The container includes a bottom wall, two end walls, each end wall including at least an end panel emanating from an end edge of the bottom wall, and two side walls, each side wall including at least a side panel emanating from a side edge of the bottom wall. The container further includes a reinforcing panel assembly emanating from a first end edge of a first side panel of a first side wall, including an outer reinforcing panel, an intermediate reinforcing panel, and an inner reinforcing panel, wherein the outer reinforcing panel is positioned in a substantially face-to-face relationship with the intermediate reinforcing panel, the intermediate reinforcing panel being coupled to a first end panel of a first end wall, and the inner reinforcing panel being in a face-to-face relationship with the first side panel.

23 Claims, 3 Drawing Sheets

(56) References Cited

U.S. PATENT DOCUMENTS

| | | | |
|---|---|---|---|
| 3,952,634 | A | 4/1976 | Rollins et al. |
| 3,978,774 | A | 9/1976 | Royal |
| 4,056,223 | A | 11/1977 | Williams |
| 4,139,146 | A | 2/1979 | Bamburg et al. |
| 4,211,153 | A | 7/1980 | Walters et al. |
| 4,215,525 | A | 8/1980 | Nigrelli |
| 4,235,364 | A | 11/1980 | Baker |
| 4,261,254 | A | 4/1981 | Nowacki |
| 4,308,023 | A | 12/1981 | Bidegain |
| 4,516,210 | A | 5/1985 | Dahlke |
| 4,581,005 | A | 4/1986 | Moen |
| 4,621,766 | A | 11/1986 | McClure |
| 4,624,653 | A | 11/1986 | McBride |
| 4,636,187 | A | 1/1987 | Oakley |
| 4,674,998 | A | 6/1987 | Benedicenti |
| 4,676,428 | A | 6/1987 | McClure |
| 4,676,429 | A | 6/1987 | Crowe et al. |
| 4,792,084 | A | 12/1988 | Dreeszen |
| 4,843,798 | A | 7/1989 | Focke et al. |
| 4,919,326 | A | 4/1990 | Deiger |
| 4,988,331 | A | 1/1991 | Boisseau |
| 5,000,377 | A | 3/1991 | McClure |
| 5,002,224 | A | 3/1991 | Muise |
| 5,125,567 | A | 6/1992 | McClure |
| 5,139,195 | A | 8/1992 | McClure |
| 5,147,271 | A | 9/1992 | Bacques et al. |
| 5,207,375 | A | 5/1993 | McClure |
| 5,261,594 | A | 11/1993 | Brown et al. |
| 5,285,956 | A | 2/1994 | Piepho |
| 5,289,970 | A | 3/1994 | McClure |
| 5,289,971 | A | 3/1994 | McClure |
| 5,295,631 | A | 3/1994 | McClure |
| 5,372,569 | A | 12/1994 | Ballos, III |
| 5,400,955 | A | 3/1995 | Coalier et al. |
| 5,487,504 | A | 1/1996 | Baird |
| 5,535,941 | A | 7/1996 | Garza |
| 5,588,585 | A | 12/1996 | McClure |
| 5,624,031 | A | 4/1997 | Fowler et al. |
| 5,673,848 | A | 10/1997 | Garza |
| 5,687,902 | A | 11/1997 | Tusing et al. |
| 5,752,648 | A | 5/1998 | Quaintance |
| 5,807,225 | A | 9/1998 | Nowacki et al. |
| 5,876,319 | A | 3/1999 | Holton |
| 5,950,911 | A | 9/1999 | Naughton et al. |
| 5,996,885 | A | 12/1999 | Chu |
| 6,015,084 | A | 1/2000 | Mathieu et al. |
| 6,131,805 | A | 10/2000 | Gasior |
| 6,223,978 | B1 | 5/2001 | Drager |
| 6,367,690 | B1 | 4/2002 | McClure |
| 6,575,356 | B2 | 6/2003 | McClure |
| 6,595,411 | B2 | 7/2003 | McClure |
| 6,651,875 | B2 | 11/2003 | Chu |
| 7,152,777 | B2 | 12/2006 | McClure |
| 7,290,696 | B2 | 11/2007 | McClure |
| 7,470,225 | B2 | 12/2008 | Herrin |
| 7,470,226 | B1 | 12/2008 | Herrin |
| 7,559,884 | B2 | 7/2009 | Kisch |
| 7,857,743 | B2 | 12/2010 | Barner |
| 7,922,069 | B2 | 4/2011 | Gardner |
| 7,935,041 | B2 | 5/2011 | Graham et al. |
| 8,087,569 | B2 | 1/2012 | Ledvina |
| 8,105,223 | B2 | 1/2012 | Graham et al. |
| 8,128,547 | B2 | 3/2012 | Graham et al. |
| 8,800,850 | B2 * | 8/2014 | MacLeod ..... B65D 5/2033 229/109 |
| 2005/0067478 | A1 | 3/2005 | McClure |
| 2005/0137072 | A1 | 6/2005 | Jackson |
| 2007/0000984 | A1 * | 1/2007 | McClure ..... B65D 5/6632 229/143 |
| 2007/0000985 | A1 | 1/2007 | McClure |
| 2007/0000986 | A1 | 1/2007 | McClure |
| 2008/0000784 | A1 | 1/2008 | McClure |
| 2009/0266873 | A1 | 10/2009 | Ledvina |
| 2009/0277952 | A1 | 11/2009 | Smith |
| 2009/0280973 | A1 | 11/2009 | Graham et al. |
| 2012/0100977 | A1 | 4/2012 | Graham et al. |
| 2013/0200137 | A1 * | 8/2013 | Smith ..... B65D 1/225 229/108 |
| 2014/0249008 | A1 | 9/2014 | Aganovic et al. |

OTHER PUBLICATIONS

International Search Report and Written Opinion, dated Nov. 13, 2014, for International application No. PCT/US14/37542 (12 pgs.).

* cited by examiner

REINFORCED CONTAINERS AND BLANKS FOR MAKING THE SAME

CROSS-REFERENCE TO RELATED APPLICATIONS

This application claims priority to U.S. Provisional Patent Application No. 62/074,909, filed Nov. 4, 2014, entitled "REINFORCED CONTAINERS AND BLANKS FOR MAKING THE SAME," the entire contents of which are hereby incorporated by reference in their entirety.

BACKGROUND

The embodiments described herein relate generally to a blank and a reinforced container formed from the blank and, more particularly, to a blank having a reinforcing panel assembly configured to reinforce a corner portion of the container.

Containers are frequently utilized to store and transport products. In at least some known cases, a blank of sheet material is used to form these containers. More specifically, these known containers are formed by folding a plurality of panels of the blank along preformed fold lines. To form at least some known containers, some of the panels are secured using an adhesive. Such known containers are formed using a machine and/or by hand.

At least some such containers have certain strength requirements for storing and transporting products. These strength requirements may include a stacking strength requirement such that the containers can be stacked on one another during transport without collapsing. To meet these strength requirements, at least some known containers include reinforced walls at corner portions of the container for providing additional strength, including stacking strength. In at least some known containers, reinforcing panels are attached to an interior surface of the corner portions of the formed container. However, such containers are less than optimal for certain applications, such as but not limited to storing and transporting fresh fruit or produce, because the interior reinforced panels create interior edges or non-planar interior surfaces that can damage or "bruise" the contents within the container.

BRIEF DESCRIPTION

In one aspect, a container formed from a blank is provided. The container includes a bottom wall, two opposing end walls, each end wall including at least an end panel emanating from an end edge of the bottom wall, and two opposing side walls, each side wall including at least a side panel emanating from a side edge of the bottom wall. The container further includes a first reinforcing panel assembly emanating from a first end edge of a first side panel of a first side wall of the two side walls, the first reinforcing panel assembly including an outer reinforcing panel emanating from the first end edge of the first side panel, an intermediate reinforcing panel emanating from a first end edge of the outer reinforcing panel, and an inner reinforcing panel emanating from a first end edge of the intermediate reinforcing panel. The outer reinforcing panel is positioned in a substantially face-to-face relationship with the intermediate reinforcing panel, the intermediate reinforcing panel being coupled to a first end panel of a first end wall of the two end walls, and the inner reinforcing panel is in a substantially face-to-face relationship with the first side panel.

In another aspect, an assembly of stacked containers is provided. The assembly of stacked containers includes a first container and a second container positioned on top of the first container. The first container includes a first side wall including at least a first side panel and a first end wall adjacent to the first side wall, the first end wall including a first end panel in an overlying relationship with a first rollover panel. The first container further includes a first reinforcing panel assembly emanating from a first end edge of the first side panel, the first reinforcing panel assembly including a first outer reinforcing sub-assembly and a first inner reinforcing panel. The first side panel, the first end panel, the first rollover panel, the first outer reinforcing sub-assembly, and the first inner reinforcing panel define a first reinforced corner structure. The second container includes a second side wall including at least a second side panel, the second side wall vertically aligned with the first side wall of the first container, and a second end wall vertically aligned with the first end wall of the first container, the second end wall including a second end panel in an overlying relationship with a second rollover panel. The second container further includes a second reinforcing panel assembly emanating from a first end edge of the second side panel, the second reinforcing panel assembly including a second outer reinforcing sub-assembly and a second inner reinforcing panel. The second side panel, the second end panel, the second rollover panel, the second outer reinforcing sub-assembly, and the second inner reinforcing panel define a second reinforced corner structure.

In yet another aspect, a method for forming a container from a blank is provided. The blank includes a bottom panel, two opposing end panels each extending from an end edge of the bottom panel, two opposing side panels each extending from a side edge of the bottom panel, and a first reinforcing panel assembly extending from a first end edge of a first side panel of the two side panels. The first reinforcing panel assembly includes an outer reinforcing panel, an intermediate reinforcing panel, and an inner reinforcing panel. The method includes rotating the intermediate reinforcing panel toward an interior surface of the outer reinforcing panel, said rotating aligning the intermediate reinforcing panel and the outer reinforcing panel in a substantially face-to-face relationship, rotating each end panel inwardly into a substantially perpendicular relationship with the bottom panel, and rotating the first side panel inwardly into a substantially perpendicular relationship with the bottom panel. The method further includes rotating the outer reinforcing panel and the intermediate reinforcing panel into a substantially perpendicular relationship with the first side panel, the rotating positioning the intermediate reinforcing panel and a portion of a first end panel of the two end panels in a substantially face-to-face relationship, and securing the intermediate reinforcing panel to the first end panel to form the container.

In a further aspect, a blank for constructing a container is provided. The blank includes a bottom panel and a plurality of side panels extending from the bottom pane. The plurality of side panels includes a first end panel extending from a first end edge of the bottom panel and a first side panel extending from a first side edge of the bottom panel. The blank further includes a first reinforcing panel assembly extending from a first end edge of the first side panel, the first reinforcing panel assembly including a first outer reinforcing sub-assembly and a first inner reinforcing panel extending from the first outer reinforcing sub-assembly opposite the first side panel. The first outer reinforcing sub-assembly is configured to be coupled to the first end panel when the container is constructed from the blank.

DETAILED DESCRIPTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The embodiments described herein provide a stackable, reinforced container formed from a single sheet of blank material, and a method for constructing the container. The container may be constructed from a blank of sheet material using a machine and/or by hand. In one embodiment, the blank is fabricated from a corrugated cardboard material. The blank, however, may be fabricated using any suitable material, and therefore is not limited to a specific type of material. In alternative embodiments, the blank is fabricated using cardboard, plastic, fiberboard, paperboard, foamboard, corrugated paper, and/or any suitable material known to those skilled in the art and guided by the teachings herein provided.

In an example embodiment, the blank includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the blank is void of markings, such as, without limitation, indicia that communicates the product, a manufacturer of the product and/or a seller of the product.

Figure 1:
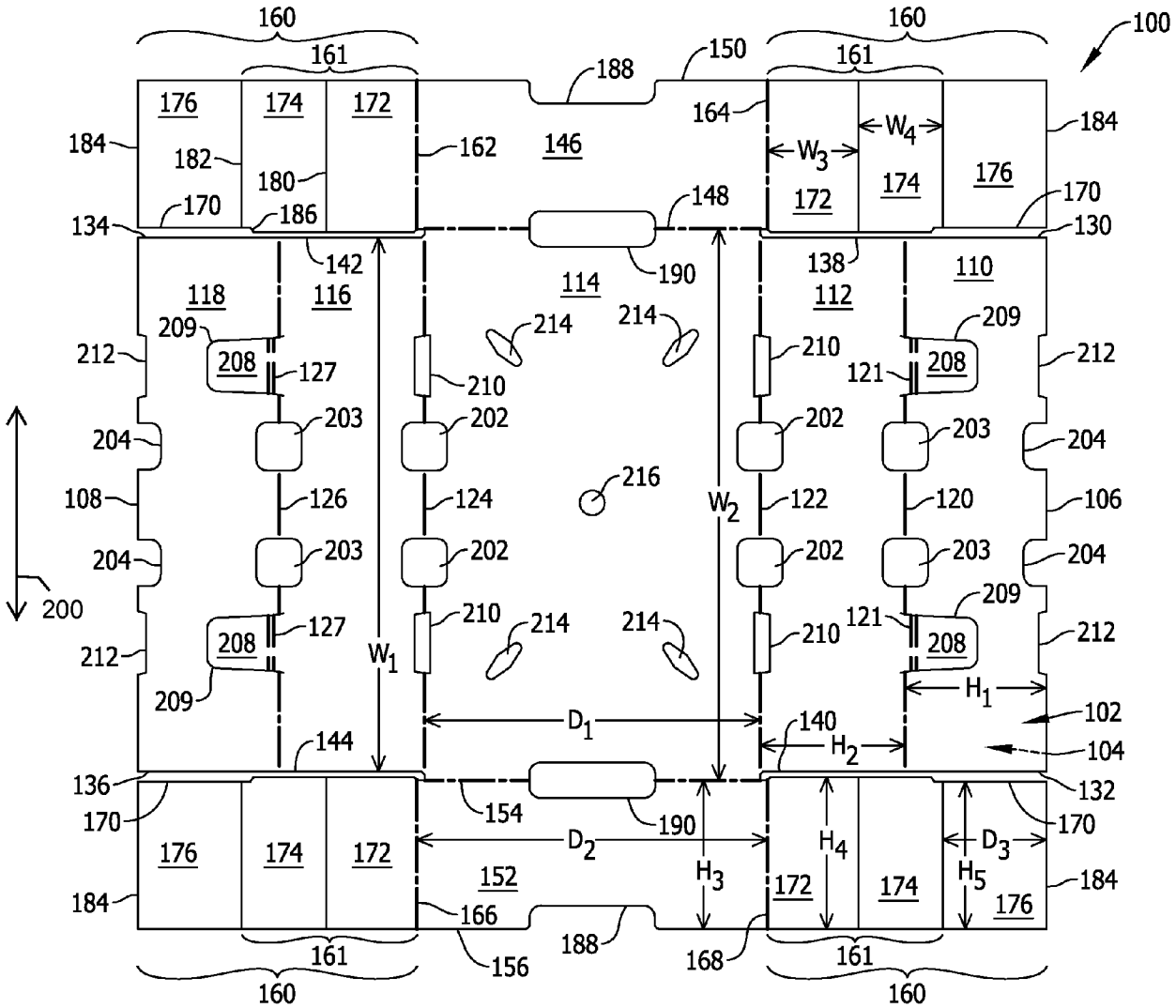
FIG. 1 is a top plan view of an example embodiment of a blank of sheet material for constructing a container.
Figure 2:
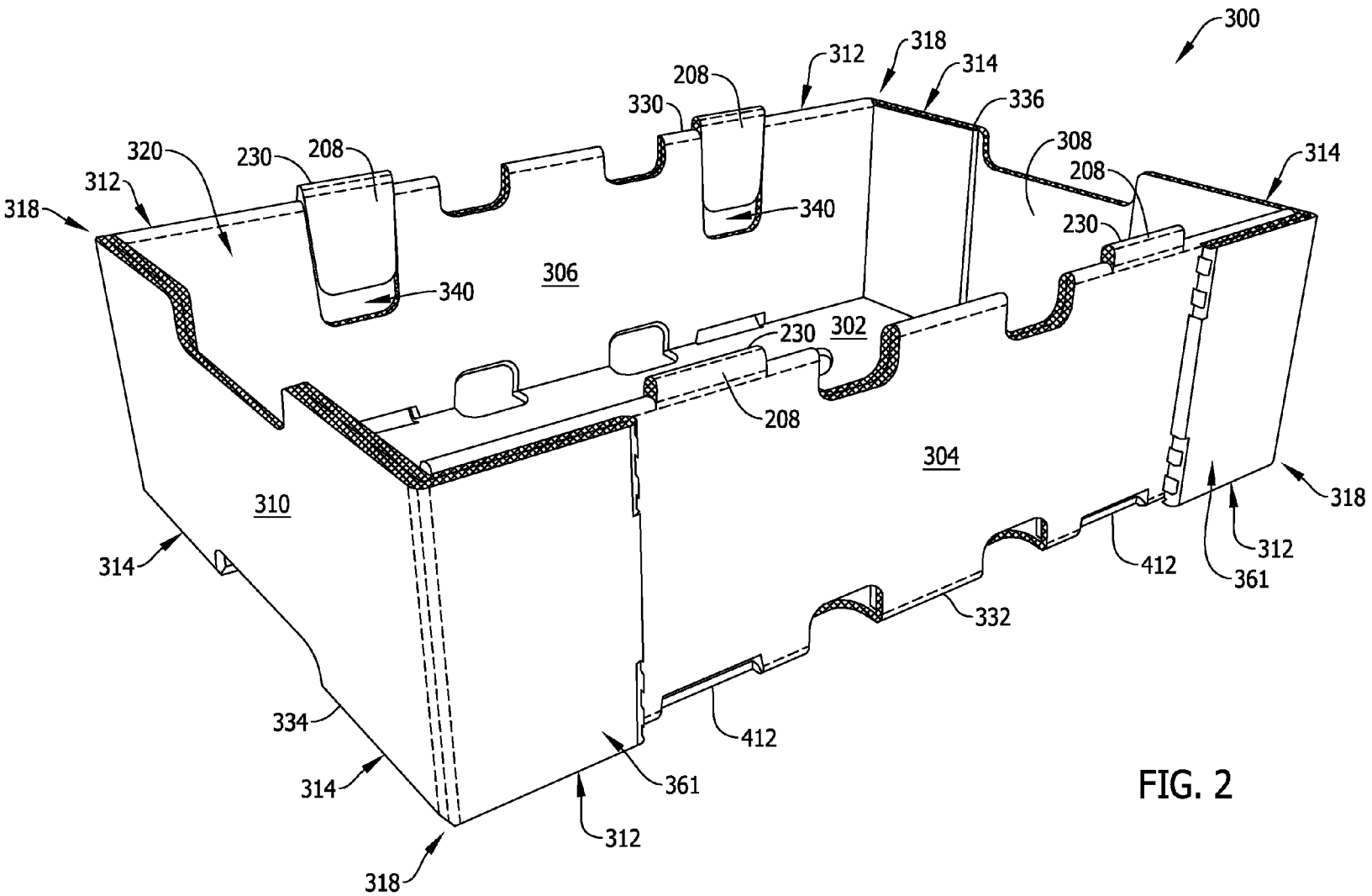
FIG. 2 is a perspective view of an example embodiment of a container that may be formed from the blank shown in FIG. 1.
Figure 3:
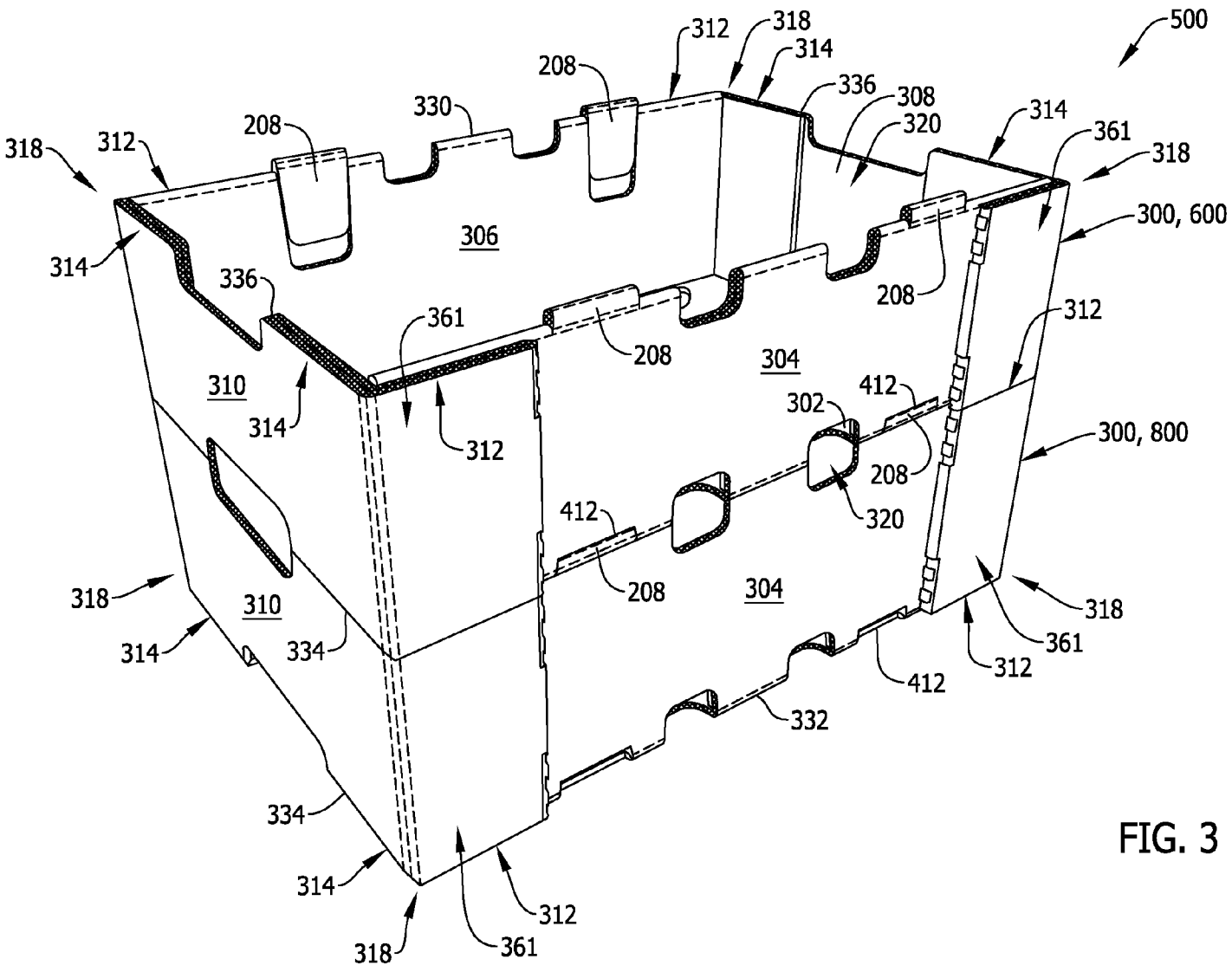
FIG. 3 is a perspective view of two of the example containers shown in FIG. 2 in a stacked configuration.

Reference will now be made to the drawings, and more specifically to FIG. 1, which is a top plan view of an example embodiment of a blank 100 of sheet material. FIG. 2 is a perspective view of an example embodiment of a container 300 formed from blank 100. FIG. 3 is a perspective view of two stacked containers 300, designated as a first container 600 and a second container 800, in a stacked configuration.

Blank 100 has a first or interior surface 102 and an opposing second or exterior surface 104. Further, blank 100 defines a leading edge 106 and an opposing trailing edge 108. In one embodiment, blank 100 includes, in series from leading edge 106 to trailing edge 108, a plurality of side panels (at least one of which may be referred to as "end panels"), including, specifically, a first rollover panel 110, a first end panel 112, a bottom panel 114, a second end panel 116, and a second rollover panel 118 coupled together along preformed, generally parallel, fold lines 120, 122, 124, and 126, respectively. More specifically, first rollover panel 110 extends between leading edge 106 and fold line 120, first end panel 112 extends from fold line 120, bottom panel 114 extends from fold line 122, second end panel 116 extends from fold line 124, and second rollover panel 118 extends between fold line 126 and trailing edge 108. Fold line 120 defines a top edge of first rollover panel 110 and a top edge of first end panel 112. Fold line 122 defines a bottom edge of first end panel 112 and a first end edge of bottom panel 114. Fold line 124 defines a bottom edge of second end panel 116 and a second end edge of bottom panel 114. Fold line 126 defines a top edge of second rollover panel 118 and a top edge of second end panel 116. Fold lines 120, 122, 124, and 126 as well as other fold lines and/or hinge lines described herein, may include any suitable line of weakening and/or line of separation known to those skilled in the art and guided by the teachings herein provided.

In the example embodiment, first rollover panel 110 and first end panel 112 are substantially congruent and have a rectangular shape, second rollover panel 118 and second end panel 116 are substantially congruent and have a rectangular shape, and bottom panel 114 has a substantially rectangular shape. Moreover, rollover panels 110 and 118 each have a height $H_1$, and end panels 112 and 116 each have a height $H_2$ that is slightly less than height $H_1$ by approximately a thickness of blank 100, to accommodate rollover panels 110, 118 being positioned in an overlying relationship with end panels 112 and 116, respectively, when container 300 (shown in FIG. 2) is formed from blank 100. In alternative embodiments, first rollover panel 110 and first end panel 112 are other than substantially congruent, and/or second rollover panel 118 and second end panel 116 are other than substantially congruent. Moreover, in alternative embodiments, each of rollover panels 110 and 118 and end panels 112 and 116 have any suitable height that enables blank 100 to function as described herein.

In the example embodiment, first rollover panel 110 includes two free side edges 130 and 132, and second rollover panel 118 includes two free side edges 134 and 136. First end panel 112 includes two free side edges 138 and 140, and second end panel 116 includes two free edges 142 and 144. Free side edges 130, 132, 134, 136, 138, 140, 142, and 144 are generally parallel to each other. In alternative embodiments, free side edges 130, 132, 134, 136, 138, 140, 142, and 144 may be other than substantially parallel to each other.

A first side panel 146 extends from bottom panel 114 along a fold line 148 to a free edge 150, and a second side panel 152 extends from bottom panel 114 along a fold line 154 to a free edge 156. Fold line 148 defines a bottom edge of first side panel 146 and a first side edge of bottom panel 114. Fold line 154 defines a bottom edge of second side panel 152 and a second side edge of bottom panel 114. In the example embodiment, first and second side panels 146 and 152 each have a generally rectangular shape, and each have a height $H_3$ that is approximately equal to height $H_2$. In alternative embodiments, each of side panels 146 and 152 has any suitable shape and height that enables blank 100 to function as described herein.

A reinforcing panel assembly 160 extends from each opposing end edge of each side panel 146 and 152. Reinforcing panel assembly 160 includes a plurality of panels as will be described herein. Each end edge of side panels 146 and 152 is defined by a respective one of fold lines 162, 164, 166, and 168. In the example embodiment, fold lines 162, 164, 166, and 168 are generally parallel to each other and to fold lines 120, 122, 124, and 126. In alternative embodiments, fold lines 162, 164, 166, and 168 may be other than substantially parallel to each other and/or to fold lines 120, 122, 124, and/or 126.

In the example embodiment, each reinforcing panel assembly 160 is substantially similar and includes an outer reinforcing sub-assembly 161, including an outer reinforcing panel 172 and an intermediate reinforcing panel 174, and an inner reinforcing panel 176. Outer reinforcing sub-assembly 161 is connected to inner reinforcing panel 176 along a fold line 182. Outer reinforcing panel 172 is connected to intermediate reinforcing panel along a fold line 180, such that outer reinforcing panel 172, intermediate reinforcing panel 173, and inner reinforcing panel 176 are connected in series. Fold lines 180 and 182 are substantially parallel to fold lines 162, 164, 166, and 168. More specifically, outer reinforcing panel 172 extends from a respective one of side panels 146 and 152 along one of fold lines 162, 164, 166, and 168, intermediate reinforcing panel 174 extends from outer reinforcing panel 172 along fold line 180, and inner reinforcing panel 176 extends from intermediate reinforcing panel 174 along fold line 182 to a free edge 184. In the example embodiment, each of outer reinforcing panels 172, intermediate reinforcing panels 174, and inner reinforcing panels 176 is substantially rectangular in shape. In alternative embodiments, each of outer reinforcing panels 172, intermediate reinforcing panels 174, and inner reinforcing panels 176 has any suitable shape that enables blank 100 to function as described herein.

In the example embodiment, bottom panel 114 has a depth $D_1$. Side panels 146 and 152 each have a depth $D_2$ that is slightly longer than depth $D_1$ such that bottom panel 114 is narrower than each of side panels 146 and 152 by about twice a thickness of blank 100. Further, each of end panels 112 and 116 and rollover panels 110 and 118 have a width $W_1$. Bottom panel 114 has a width $W_2$ that is slightly longer than width $W_1$. In other words, each of fold lines 162, 164, 166, and 168 is offset or spaced apart from a respective one of fold lines 122 and 124 by a distance equal to approximately twice the thickness of blank 100 to accommodate each outer reinforcing panel 172 and intermediate reinforcing panel 174 being coupled to exterior surface 104 of respective end panels 112 and 116 when container 300 is formed from blank 100. Moreover, free side edges 138, 140, 142, and 144 of end panels 112 and 116 and rollover panels 110 and 118 are offset or spaced apart from fold lines 148 and 154 sufficiently to accommodate each inner reinforcing panel 176 extending between the respective one of free side edges 138, 140, 142, and 144 and one of side panels 146 and 152 when container 300 is formed from blank 100. In alternative embodiments, each of bottom panel 114, side panels 146 and 152, end panels 112 and 116, and rollover panels 110 and 118 have any suitable depth and width that enables blank 100 to function as described herein.

In the example embodiment, outer reinforcing panels 172 have a width $W_3$, and intermediate reinforcing panels 174 have a width $W_4$ that is approximately equal to width $W_3$. Further, inner reinforcing panels 176 have a depth $D_3$ that is less than or equal to half of depth $D_2$, such that when container 300 is formed from blank 100, each inner reinforcing panel 176 is aligned in an overlying relationship with at least a portion of a respective side panel 146 or 152, without overlap between inner reinforcing panels 176. In alternative embodiments, each of outer reinforcing panels 172, intermediate reinforcing panels 174, and inner reinforcing panels 176 has any suitable depth/width that enables blank 100 to function as described herein. For example, in one embodiment, inner reinforcing panels 176 have a depth $D_3$ that is substantially equal to half to depth $D_2$, such that when container 300 is formed from blank 100, inner reinforcing panels 176 define a substantially planar interior surface of side walls 308 and 310 (shown in FIG. 2).

In the example embodiment, each outer reinforcing panel 172 has a height $H_4$. Each inner reinforcing panel 176 has a height $H_5$ that is less than height $H_4$ by about the thickness of blank 100, such that at least a portion of an inner bottom edge 170 of each inner reinforcing panel 176 is positioned against interior surface 102 of bottom panel 114 when blank 100 is articulated to form container 300. Each intermediate reinforcing panel 174 has a height that transitions from height $H_5$ to height $H_4$ at a transition 186. Transition 186 is spaced from fold line 182 by approximately the thickness of blank 100 to accommodate positioning inner reinforcing panel 176 on bottom panel 114 and between one of side panels 146 and 152 and one of free edges 138, 140, 142, or 144 of end panels 112 or 116 when container 300 is formed. In alternative embodiments, each of outer reinforcing panels 172, intermediate reinforcing panels 174, and inner reinforcing panels 176 has any suitable height that enables blank 100 to function as described herein.

In the example embodiment, blank 100 is fabricated from a corrugated cardboard material and includes a plurality of corrugations or flutes (not shown) therein, oriented parallel to a corrugation direction indicated at 200. As described further herein, corrugation direction 200 facilities improved strength of container 300.

In the example embodiment, a notch 188 is defined along each free edge 150 and 156 of side panels 146 and 152, respectively. Further, one of a pair of cutouts 190 is defined along each fold line 148 and 154. In the example embodiment, each cutout 190 is defined partially within bottom panel 114 and partially within one of side panels 146 and 152. Moreover, each notch 188 is substantially aligned with a respective cutout 190, such that when a first container 300 is formed and stacked atop a second container 300 (shown as first container 600 and second container 800 in FIG. 3), each cutout 190 of the first container aligns with corresponding notch 188 of the second container.

Similarly, a pair of cutouts 202 is defined along each fold line 122 and 124. Each cutout 202 is defined partially within bottom panel 114 and partially within one of end panels 112 and 116. A pair of cutouts 203 is defined along each fold line 120 and 126. Each cutout 203 is defined partially within one of end panels 112 and 116 and partially within an adjacent one of rollover panels 110 and 118. Moreover, a pair of notches 204 is defined within each of rollover panels 110 and 118 along each of leading edge 106 and trailing edge 108. Each cutout 202 is substantially aligned with a respective cutout 203 and notch 204, such that when first container 300 is formed and stacked atop a second container 300 (shown in FIG. 3), each notch 204 of the first container aligns with a corresponding cutout 202 of the first container and a corresponding cutout 203 of the second container.

Thus, notches 188, cutouts 190, cutouts 202, cutouts 203, and notches 204 may be configured to provide venting between a cavity 320 of each container 300 and an exterior of container 300. In alternative embodiments, blank 100 includes notches 188, cutouts 190, cutouts 202, cutouts 203, and notches 204 in any suitable number and configuration that enables blank 100 and/or container 300 to function as described herein. For example, in certain embodiments, blank 100 does not include at least one of notches 188, cutouts 190, cutouts 202, cutouts 203, and notches 204. For another example, in certain embodiments, blank 100 does not include any of notches 188, cutouts 190, cutouts 202, cutouts 203, and notches 204.

In the example embodiment, a plurality of stacking tabs 208 are defined in each of first rollover panel 110 and second rollover panel 118. Stacking tabs 208 are defined in first rollover panel 110 by respective tab fold lines 121 and respective cut lines 209. Stacking tabs 208 are defined in second rollover panel 118 by respective tab fold lines 127 and respective cut lines 209. In the example embodiment, tab fold lines 121 are offset from fold line 120, and tab fold lines 127 are offset from fold line 126, such that when each stacking tab 208 is rotated about its respective tab fold line by 180 degrees when container 300 is formed, each of tab fold lines 121 and 127 project above a top edge 330 of end walls 304 and 306. Each of tab fold lines 121 and 127 forms a top edge 230 (shown in FIG. 2) of a respective stacking tab 208 when container 300 is formed. Further in the example embodiment, tab fold lines 121 and 127 are preformed as double fold lines to facilitate rotation of each tab 208 about its respective tab fold line by 180 degrees when container 300 is formed. In alternative embodiments, blank 100 and container 300 include any suitable number of stacking tabs 208, including zero stacking tabs 208, formed by any suitable structure that enables container 300 to function as described herein.

Further, in the example embodiment, a plurality of cutouts 210 is defined along each fold line 122 and 124, and a pair of notches 212 is defined along each of leading edge 106 and trailing edge 108. In the example embodiment, each cutout 210 is defined partially within bottom panel 114 and partially within one of end panels 112 and 116. Each cutout 202 is substantially aligned with a respective stacking tab 208 and notch 212, such that when first container 300 is formed and stacked atop a second container 300 (shown in FIG. 3), each notch 212 of the first container aligns with a corresponding cutout 210 of the first container to form a slot 412, and each slot 412 receives a corresponding stacking tab 208 of the second container.

In the example embodiment, four substantially elliptical cutouts 214 are defined within bottom panel 114. Further, one circular cutout 216 is defined within bottom panel 114. Alternatively, cutouts 214 and 216 may be of any shape. Alternatively, bottom panel 114 may include more or fewer than four cutouts 214 and/or one cutout 216, or bottom panel 114 may not include any cutouts 214 and/or 216.

Turning more specifically to FIG. 2, container 300 includes a bottom wall 302, a pair of opposing end walls 304 and 306, and a pair of opposing side walls 308 and 310. In the example embodiment, each of end walls 304 and 306 is generally perpendicular to each of side walls 308 and 310, and each of end walls 304 and 306 and side walls 308 and 310 is generally perpendicular to bottom wall 302, such that container 300 has a generally rectangular shape. In alternative embodiments, end walls 304 and 306, side walls 308 and 310, and bottom wall 302 have any relative orientation that enables container 300 to function as described herein. End walls 304 and 306, side walls 308 and 310, and bottom wall 302 cooperate to define cavity 320 of container 300.

In the example embodiment, bottom wall 302 includes bottom panel 114. First side wall 308 includes first side panel 146, inner reinforcing panel 176 of reinforcing panel assembly 160 that extends from a first end edge defined along fold line 162 of first side panel 146, and inner reinforcing panel 176 of reinforcing panel assembly 160 that extends from a second, opposing end edge defined along fold line 164 of first side panel 146. Accordingly, at least a portion of first side wall 308 has a thickness approximately equal to twice a thickness of blank 100. Second side wall 310 includes second side panel 152, inner reinforcing panel 176 of reinforcing panel assembly 160 that extends from a first end edge defined along fold line 166 of second side panel 152, and inner reinforcing panel 176 of reinforcing panel assembly 160 that extends from a second, opposing end edge defined along fold line 168 of second side panel 152. Accordingly, at least a portion of second side wall 310 has a thickness approximately equal to twice a thickness of blank 100. More specifically, interior surface 102 of each inner reinforcing panel 176 is in a substantially face-to-face relationship with interior surface 102 of the corresponding one of side panels 146 and 152. In the example embodiment, inner bottom edge 170 of each inner reinforcing panel 176 is positioned against interior surface 102 of bottom wall 302. In alternative embodiments, inner bottom edge 170 of at least one inner reinforcing panel 176 is not positioned against interior surface 102 of bottom wall 302.

Further in the example embodiment, first end wall 304 includes first rollover panel 110, first end panel 112, a first outer reinforcing structure 361 formed from one of outer reinforcing sub-assemblies 161, and a second outer reinforcing structure 361 formed from another of outer reinforcing sub-assemblies 161. Specifically, first end wall 304 includes the first outer reinforcing structure 361 that includes intermediate reinforcing panel 174 and outer reinforcing panel 172 of reinforcing panel assembly 160 that extends from the second end edge defined along fold line 164 of first side panel 146, and the second outer reinforcing structure 361 that includes intermediate reinforcing panel 174 and outer reinforcing panel 172 of reinforcing panel assembly 160 that extends from the second end edge defined along fold line 168 of second side panel 152. Accordingly, at least a portion of first end wall 304 has a thickness approximately equal to four times a thickness of blank 100.

Second end wall 306 includes second rollover panel 118, second end panel 116, a third outer reinforcing structure 361 (not shown in the view of FIG. 2) formed from another of outer reinforcing sub-assemblies 161, and a fourth outer reinforcing structure 361 (not shown in the view of FIG. 2) formed from another of outer reinforcing sub-assemblies 161. Specifically, second end wall 306 includes the third outer reinforcing structure 361 that includes intermediate reinforcing panel 174 and outer reinforcing panel 172 of reinforcing panel assembly 160 that extends from the first end edge defined along fold line 162 of first side panel 146, and the fourth outer reinforcing structure that includes intermediate reinforcing panel 174 and outer reinforcing panel 172 of reinforcing panel assembly 160 that extends from the first end edge defined along fold line 166 of second side panel 152. Accordingly, at least a portion of second end wall 306 has a thickness approximately equal to four times a thickness of blank 100.

Due to the corrugation direction 200 of flutes within blank 100, outer reinforcing sub-assemblies 161 have vertically oriented flutes when container 300 is formed from blank 100, thereby increasing a stacking strength of outer reinforcing structures 361. Moreover, as end panels 112, 116 have horizontally oriented flutes when container 300 is formed form blank 100, if end walls 304, 306 only included 112, 116, they may be structurally weak. Therefore, providing rollover panels 110, 118 to further form end walls 304, 306 increases a stacking strength of end walls 304, 306 in comparison to containers without rollover panels 110, 118.

More specifically, interior surface 102 of each outer reinforcing panel 172 is positioned in a substantially face-to-face relationship with interior surface 102 of the intermediate reinforcing panel 174 from which it extends, and exterior surface 104 of each intermediate reinforcing panel 174 is coupled to exterior surface 104 of the corresponding one of end panels 112 and 116. In the example embodiment, interior surface 102 of first rollover panel 110 is positioned in a substantially face-to-face relationship with interior surface 102 of first end panel 112, and interior surface 102 of second rollover panel 118 is positioned in a substantially face-to-face relationship with interior surface 102 of second end panel 116.

Thus, in the example embodiment, at least a reinforced portion 312 of each of end walls 304 and 306, adjacent each respective side wall 308 and 310, has a thickness defined by the respective one of rollover panels 110 and 118, the respective one of end panels 112 and 116, and the respective outer reinforcing structure 361 (i.e., the respective intermediate reinforcing panel 174 and the respective outer reinforcing panel 172), each extending from a bottom edge 332 to top edge 330 of the respective end wall 304 or 306. Similarly, at least a reinforced portion 314 of each of side walls 308 and 310, adjacent each respective end wall 304 and 306, includes a respective one of side panels 146 and 152 and a respective inner reinforcing panel 176 each extending from a bottom edge 334 to a top edge 336 of the respective side wall 308 or 310.

The reinforced end wall portions 312 and the reinforced side wall portions 314, collectively "reinforced corner structures" 318, provide an increased stacking strength for container 300 as compared, for example, to containers having fewer plies extending between a top and bottom edge. Coupling each pair of intermediate reinforcing panels 174 and outer reinforcing panels 172 to exterior surface 104, rather than interior surface 102, of the respective end panel 112 and 116 enables each rollover panel 110 and 118 to be positioned adjacent cavity 320 in an overlying and substantially face-to-face relationship with the respective end panel, such that end walls 304 and 306 each include at least two plies over substantially an entire extent of the end walls 304 and 306. Moreover, each rollover panel 110 and 118 defines a substantially smooth, planar interior surface of the respective end wall 304 and 306. It should be understood that the term "substantially smooth, planar interior surface" is satisfied even in the presence of small discontinuities such as indentations 340 defined in the interior surface of end walls 304 and 306 adjacent stacking tabs 208. As a result, container 300 with reinforced corner structures 318 is better suited for transporting products that can be easily damaged during storage or transport, such as fresh fruit or produce, as compared to a container that includes reinforcing panels with free edges adjacent a cavity of the container.

In the example embodiment, bottom panel 114 is sized to correspond to product(s) contained within container 300. Although container 300 is shown as being formed without a product to be contained therein, container 300 may also be formed around a product contained therein. Further, container 300 may include any suitable number of products of any suitable shape.

To form container 300 from blank 100, each end panel 112 and 116 is rotated toward interior surface 102 of bottom panel 114, that is, inwardly, into a substantially perpendicular relationship with bottom panel 114. Each intermediate reinforcing panel 174 is rotated about fold line 180 toward interior surface 102 of outer reinforcing panel 172, such that outer reinforcing panel 172 and intermediate reinforcing panel 174 are aligned in a substantially face-to-face relationship and each inner reinforcing panel 176 is aligned in a substantially face-to-face relationship with at least a portion of the respective one of side panels 146 and 152. Each pair of aligned outer reinforcing panels 172 and intermediate reinforcing panels 174 is rotated about at least one of fold line 180 and one of fold lines 162, 164, 166, and 168 toward interior surface 102 of the respective one of side panels 146 and 152 into a substantially perpendicular relationship with the respective one of side panels 146 and 152.

In the example embodiment, at least one of inner reinforcing panel 176, intermediate reinforcing panel 174, outer reinforcing panel 172, and the respective side panel 146 or 152 are secured in the above-described relationships. For example, inner reinforcing panel 176 may be attached to the respective one of side panels 146 and 152, and/or intermediate reinforcing panel 174 and outer reinforcing panel 172 may be attached together. Any of the panels may be attached using, for example, adhesive, another suitable bonding material, fasteners, and/or any other suitable method for attaching panels. Additionally or alternatively, at least one of inner reinforcing panel 176, intermediate reinforcing panel 174, outer reinforcing panel 172, and the respective side panel 146 or 152 is maintained in the above-described relationships by a force applied by a machine and/or by hand.

First and second side panels 146 and 152 are rotated inwardly about fold lines 148 and 154, respectively, into a substantially perpendicular relationship with bottom panel 114, such that each intermediate reinforcing panel 174 and a portion of a respective one of end panels 112 and 116 are aligned in a substantially face-to-face relationship. Each intermediate reinforcing panel 174 is attached to the respective one of end panels 112 and 116 to form container 300. For example, an adhesive is applied to at least one of exterior surface 104 of intermediate reinforcing panel 174 and the respective one of end panels 112 and 116. Alternatively or additionally, intermediate reinforcing panel 174 is attached to the respective one of end panels 112 and 116 using, for example, fasteners, another suitable bonding material, and/or any other suitable method for attaching panels.

Further in the example embodiment, each rollover panel 110 and 118 is rotated inwardly about fold line 120 and 126, respectively, into a substantially face-to-face relationship with the respective one of end panels 112 and 116. Moreover, each stacking tab 208 is rotated inwardly about a respective one of tab fold lines 121 and 127 into a substantially face-to-face relationship with the respective one of end panels 112 and 116. In the example embodiment, each stacking tab 208 is attached to the respective one of end panels 112 and 116 using, for example, an adhesive, another suitable bonding material, fasteners, and/or any other suitable method for attaching panels.

FIG. 3 is a perspective view of a stack 500 of two containers 300, designated as a first container 600 and a second container 800. Each stacking tab 208 extending from top edge 330 of end walls 304 and 306 of second container 800 is received within a corresponding slot 412 defined in bottom edge 332 of end walls 304 and 306 of first container 600, such that each reinforced end wall portion 312 of first container 600 is substantially aligned with a respective reinforced end wall portion 312 of second container 800, and each reinforced side wall portion 314 of first container 600 is substantially aligned with a respective reinforced side wall portion 314 of second container 800. More specifically, at least a portion of one or more outer reinforcing panels 172 of first container 600 is vertically aligned with at least a portion of a respective outer reinforcing panel 172 of second container 800, at least a portion of one or more intermediate reinforcing panels 174 of first container 600 is vertically aligned with a respective intermediate reinforcing panel 174 of second container 800, and at least a portion of one or more inner reinforcing panels 176 of first container 600 is vertically aligned with a respective inner reinforcing panel 176 of second container 800. As a result, at least a portion of a weight of first container 600 is transmitted to second container 800 through reinforced end wall portions 312 and reinforced side wall portions 314. Containers 600 and 800 therefore exhibit increased stacking strength (e.g., resistance to bulging or buckling). It should be understood that stack 500 may include any suitable number of stacked containers 300.

The above-described embodiments provide a reinforced container that may be formed from a single blank of sheet material. The embodiments provide a blank that includes a reinforcing panel assembly, and a container formed from the blank that has reinforced end wall portions and reinforced side wall portions. The container provides enhanced corner stacking strength in combination with opposing end walls that each include two plies over substantially an entire extent of the end wall. In addition, each end wall presents a relatively smooth, planar interior surface.

Exemplary embodiments of a container formed to contain a product therein and blanks and methods for making the same are described above in detail. The blanks, the container, and the methods are not limited to the specific embodiments described herein, but rather, components of the blanks and/or the container and steps of the method may be utilized independently and separately from other components and steps of the method described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A container formed from a blank, the container comprising:

a bottom wall;

two opposing end walls, each end wall including at least an end panel emanating from an end edge of the bottom wall;

two opposing side walls, each side wall including at least a side panel emanating from a side edge of the bottom wall; and a first reinforcing panel assembly emanating from a first end edge of a first side panel of a first side wall of the two side walls, the first reinforcing panel assembly comprising an outer reinforcing panel emanating from the first end edge of the first side panel, an intermediate reinforcing panel emanating from a first end edge of the outer reinforcing panel, and an inner reinforcing panel emanating from a first end edge of the intermediate reinforcing panel, wherein the outer reinforcing panel is positioned in a substantially face-to-face relationship with the intermediate reinforcing panel, the intermediate reinforcing panel being coupled to a first end panel of a first end wall of the two end walls, and the inner reinforcing panel is in a substantially face-to-face relationship with the first side panel.

2. The container in accordance with claim 1, wherein an exterior surface of the intermediate reinforcing panel is coupled to an exterior surface of the first end panel.

3. The container in accordance with claim 1, wherein an interior surface of the inner reinforcing panel is coupled to an interior surface of the side panel.

4. The container in accordance with claim 1, wherein a bottom edge of the inner reinforcing panel is positioned against an interior surface of the bottom wall.

5. The container in accordance with claim 1, wherein the first end wall further includes a first rollover panel emanating from a top edge of the first end panel, the first rollover panel positioned in a substantially face-to-face relationship with the first end panel.

6. The container in accordance with claim 5, wherein the first rollover panel is substantially congruent with the first end panel, such that at least a reinforced portion of the first end wall adjacent the first side wall has a thickness defined by the first rollover panel, the first end panel, the intermediate reinforcing panel, and the outer reinforcing panel each extending from a bottom edge of the first end wall to a top edge of the first end wall.

7. The container in accordance with claim 6, wherein the end walls and side walls define a cavity of the container, and wherein the first rollover panel is positioned adjacent the cavity to define a substantially planar interior surface of the first end wall.

8. The container in accordance with claim 1, further comprising:

a second reinforcing panel assembly extending from a second, opposing end edge of the first side panel of the first side wall, wherein at least a portion of the second reinforcing panel assembly is coupled to an exterior surface of a first end panel of a second end wall of the two end walls;

a third reinforcing panel assembly extending from a first end edge of a first side panel of a second side wall of the two side walls, wherein at least a portion of the third reinforcing panel assembly is coupled to an exterior surface of the first end panel of the second end wall; and a fourth reinforcing panel assembly extending from a second end edge of the first side panel of the second side wall, wherein at least a portion of the fourth reinforcing panel assembly is attached to the exterior surface of the first end panel of the first end wall.

9. The container in accordance with claim 8, wherein the second end wall further includes a second rollover panel emanating from a top edge of the first end panel of the second end wall, the second rollover panel positioned in a substantially face-to-face relationship with the first end panel of the second end wall, wherein the end walls and side walls define a cavity of the container, and wherein the second rollover panel of the second end wall is positioned adjacent the cavity to define a substantially planar surface of the second end wall.

10. An assembly of stacked containers having reinforced corner structures, said assembly comprising:

a first container comprising:

a first side wall comprising at least a first side panel;

a first end wall adjacent to the first side wall, the first end wall comprising a first end panel in an overlying relationship with a first rollover panel; and a first reinforcing panel assembly emanating from a first end edge of the first side panel, the first reinforcing panel assembly comprising a first outer reinforcing sub-assembly and a first inner reinforcing panel, wherein the first side panel, the first end panel, the first rollover panel, the first outer reinforcing sub-assembly, and the first inner reinforcing panel define a first reinforced corner structure; and a second container stacked atop the first container, the second container comprising:

a second side wall comprising at least a second side panel, the second side wall vertically aligned with the first side wall of the first container;

a second end wall vertically aligned with the first end wall of the first container, the second end wall comprising a second end panel in an overlying relationship with a second rollover panel; and a second reinforcing panel assembly emanating from a first end edge of the second side panel, the second reinforcing panel assembly comprising a second outer reinforcing sub-assembly and a second inner reinforcing panel, wherein the second side panel, the second end panel, the second rollover panel, the second outer reinforcing sub-assembly, and the second inner reinforcing panel define a second reinforced corner structure.

11. The assembly of stacked containers in accordance with claim 10, wherein the first reinforced corner structure extends from a bottom edge of the first container to a top edge of the first container, and the second reinforced corner structure extends from a bottom edge of the second container to a top edge of the second container.

12. The assembly of stacked containers in accordance with claim 11, wherein the bottom edge of the second container is positioned directly atop the top edge of the first container, and the first reinforced corner structure of the first container is substantially vertically aligned with the second reinforced corner structure of the second container.

13. The assembly of stacked containers in accordance with claim 10, wherein the bottom edge the second outer reinforcing sub-assembly is positioned directly atop the top edge of the first outer reinforcing sub-assembly, wherein the first container further comprises at least one stacking tab extending from a top edge of the first end wall and the second container further comprises at least one slot defined in a bottom edge of the second end wall, and wherein each at least one stacking tab is received within a corresponding slot of the at least one slot to vertically align the first outer reinforcing sub-assembly with the second outer reinforcing sub-assembly.

14. The assembly of stacked containers in accordance with claim 10, wherein the first outer reinforcing sub-assembly comprises a first outer reinforcing panel and a first intermediate reinforcing panel, and the second outer reinforcing subassembly comprises a second outer reinforcing panel and a second intermediate reinforcing panel.

15. A method for forming a container from a blank, the blank including a bottom panel, two opposing end panels each extending from an end edge of the bottom panel, two opposing side panels each extending from a side edge of the bottom panel, and a first reinforcing panel assembly extending from a first end edge of a first side panel of the two side panels, the first reinforcing panel assembly including an outer reinforcing panel, an intermediate reinforcing panel, and an inner reinforcing panel, the method comprising:

rotating the intermediate reinforcing panel toward an interior surface of the outer reinforcing panel, said rotating aligning the intermediate reinforcing panel and the outer reinforcing panel in a substantially face-to-face relationship;

rotating each end panel inwardly into a substantially perpendicular relationship with the bottom panel;

rotating the first side panel inwardly into a substantially perpendicular relationship with the bottom panel;

rotating the outer reinforcing panel and the intermediate reinforcing panel into a substantially perpendicular relationship with the first side panel, said rotating positioning the intermediate reinforcing panel and a portion of a first end panel of the two end panels in a substantially face-to-face relationship; and securing the intermediate reinforcing panel to the first end panel to form the container.

16. The method in accordance with claim 15, wherein securing the intermediate reinforcing panel to the first end panel comprises securing an exterior surface of the intermediate reinforcing panel to an exterior surface of the first end panel.

17. The method in accordance with claim 15 further comprising positioning a bottom edge of the inner reinforcing panel against an interior surface of the bottom panel.

18. The method in accordance with claim 15, wherein the blank further comprises a rollover panel extending from a top edge of the first end panel, the method further comprising rotating the rollover panel into an overlying relationship with the first end panel to define a substantially planar interior surface of the first end wall.

19. The method in accordance with claim 15, wherein said rotating the intermediate reinforcing panel toward an interior surface of the outer reinforcing panel further positions an interior surface of the inner reinforcing panel in a substantially face-to-face relationship with at least a portion of an interior surface of the first side panel.

20. The method in accordance with claim 15, wherein the blank further includes at least one stacking tab defined along a top edge of the first end panel, said method further comprising rotating the at least one stacking tab about a respective fold line offset from the top edge of the first end panel, said rotating extending at least a portion of the at least one stacking tab above the top edge of the first end panel when the container is formed, facilitating stacking of the container.

21. A blank for constructing a container, said blank comprising:

a bottom panel;

a plurality of side panels extending from the bottom panel, the plurality of side panels including:

a first end panel extending from a first end edge of the bottom panel; and a first side panel extending from a first side edge of the bottom panel; and a first reinforcing panel assembly extending from a first end edge of the first side panel, the first reinforcing panel assembly comprising:

a first outer reinforcing sub-assembly; and a first inner reinforcing panel extending from the first outer reinforcing sub-assembly opposite the first side panel, wherein the first outer reinforcing sub-assembly is configured to be coupled to the first end panel when the container is constructed from the blank; and a first rollover panel extending from a top edge of the first end panel, the first rollover panel substantially congruent with the first end panel and configured to be positioned in an overlying relationship with the first end panel when the container is constructed from the blank.

22. The blank in accordance with claim 21, wherein the first outer reinforcing sub-assembly comprises:

a first outer reinforcing panel; and a first intermediate reinforcing panel substantially congruent to the first outer reinforcing panel, the first intermediate panel extending between the first outer reinforcing panel and the first inner reinforcing panel.

23. The blank in accordance with claim 22, wherein the first outer reinforcing panel has a first height, the first inner reinforcing panel has a second height, and the first intermediate reinforcing panel includes a transition configured to transition a height of the first reinforcing panel assembly between the first height and the second height to facilitate positioning a bottom edge of the first inner reinforcing panel against an interior surface of the bottom wall when the container is constructed from the blank.

* * * * *